US006531821B1

(12) United States Patent
Ikedo et al.

(10) Patent No.: US 6,531,821 B1
(45) Date of Patent: Mar. 11, 2003

(54) GAS DISCHARGE TUBE

(75) Inventors: Tomoyuki Ikedo, Shizuoka-ken (JP); Kouzou Adachi, Shizuoka-ken (JP); Yoshinobu Ito, Shizuoka-ken (JP); Ryotaro Matui, Shizuoka-ken (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 313 days.

(21) Appl. No.: 09/598,990

(22) Filed: Jun. 22, 2000

Related U.S. Application Data

(63) Continuation-in-part of application No. PCT/JP98/05819, filed on Dec. 22, 1998.

(30) Foreign Application Priority Data

Dec. 24, 1997 (JP) ..... 9-355352
Sep. 7, 1998 (JP) ..... 10-252590
Sep. 7, 1998 (JP) ..... 10-252595

(51) Int. Cl.[7] ..... H01J 17/12
(52) U.S. Cl. ..... 313/613; 313/614; 313/615; 313/643; 313/588
(58) Field of Search ..... 313/588, 613, 313/643, 614, 615

(56) References Cited

U.S. PATENT DOCUMENTS 5,552,669 A * 9/1996 Ikedo et al. ..... 313/292

FOREIGN PATENT DOCUMENTS

| | | |
|---|---|---|
| JP | 4-341750 | 11/1992 |
| JP | 6-60852 | 3/1994 |
| JP | 7-326324 | 12/1995 |
| JP | 8-64179 | 3/1996 |
| JP | 8-77965 | 3/1996 |
| JP | 8-77969 | 3/1996 |
| JP | 8-77979 | 3/1996 |
| JP | 8-222185 | 8/1996 |
| JP | 8-222186 | 8/1996 |
| JP | 8-236081 | 9/1996 |
| JP | 10-302729 | 11/1998 |
| JP | 10-302730 | 11/1998 |
| JP | 10-302731 | 11/1998 |

* cited by examiner

*Primary Examiner*—Sandra O'Shea
*Assistant Examiner*—Peter Macchiarolo
(74) *Attorney, Agent, or Firm*—Morgan, Lewis & Bockius LLP

(57) ABSTRACT

While high heat is generated in the anode section in the gas discharge tube in accordance with the present invention during its use, the heat is transmitted to the stem by way of the anode support plate due to a configuration in which the anode support plate abuts against the stem, and is released outside from the stem, whereby the cooling efficiency of the anode section is improved. Since the anode section employs not a floating structure including stem pins interposed therein but a configuration in which it is seated on the stem by way of the anode support plate, the anode section is stabilized on the stem, whereby the resistance to vibration improves. Also, for assembling the anode section into a sealed envelope, it will be sufficient if the anode support plate is mounted on the stem, which contributes to improving the easiness in assembling the gas discharge tube.

8 Claims, 13 Drawing Sheets

GAS DISCHARGE TUBE

RELATED APPLICATION

This is a Continuation-In-Part application of International Patent Application Ser. No. PACT/JP98/05819 filed on Dec. 22, 1998, now pending.

BACKGROUND OF THE INVENTION

1. Field of the Invention

The present invention relates to a gas discharge tube; and, in particular, to a gas discharge tube for use as a light source for a spectroscope, chromatography, or the like.

2. Related Background Art

As a technique in such a field, one disclosed in Japanese Patent Application Laid-Open No. 7-326324 has conventionally been known. In the gas discharge tube described in this publication, a sealed envelope is constituted by a side tube made of glass and a stem made of glass, and anode and cathode sections are secured to the upper ends of the stem pins, respectively. Also, the anode and cathode sections are contained in a cylindrical light-emitting part assembly, which has a floating structure in a state spaced from the stem, and each stem pin is surrounded by an electrically insulating pipe such that the stem pins are not exposed between the light-emitting part assembly and the stem. In order for the gas discharge tube to be utilized as a UV light source, the sealed envelope is filled with about several Torr of deuterium gas.

SUMMARY OF THE INVENTION

Since the conventional gas discharge tube is configured as mentioned above, however, there have been problems as follows.

Namely, while the light-emitting part assembly is supported by a plurality of stem pins, a floating structure including electrically insulating pipes interposed therein is employed, whereby it is hard to secure a resistance to vibration, and its use may be restricted.

In order to overcome the above-mentioned problems, it is an object of the present invention to provide a gas discharge tube having an improved resistance to vibration, enhancing the heat-radiating characteristic of the anode section, and facilitating the easiness in assembling.

For overcoming the above-mentioned problems, the gas discharge tube in accordance with the present invention is a gas discharge tube having a sealed envelope at least a part of which transmits light. The sealed envelope is filled with a gas and is provided with anode and cathode sections disposed therein. The electric discharge is generated between the anode and cathode sections, so that the light-transmitting part of the sealed envelope emits predetermined light outside. The sealed envelope comprises of a stem for securing the anode and cathode sections by way of respective stem pins independent from each other, a side tube, made of a material at least a part of which transmits light and secured to the stem, surrounding the anode and cathode sections, and an anode support plate abutting against the stem so as to support the anode section on a surface thereof.

Though this gas discharge tube generates a high heat in the anode section while in use, it employs a configuration in which the anode support plate abuts against the stem, whereby the heat is transmitted to the stem by way of the anode support plate and is released outside by way of the stem. As a consequence, the cooling efficiency of the anode section can be improved, which contributes to improving the stabilization of operation characteristics. Also, since the anode section employs not a floating structure including stem pins interposed therein but a configuration in which the anode section is seated on the stem in a state where the support plate is interposed, the anode section is stabilized, and the resistance to vibration is improved. For assembling the anode section into the sealed envelope, it will be sufficient if the anode support plate is simply mounted on the stem, which contributes to improving the easiness in assembling as well.

Preferably, the anode support plate may be made of an electrically insulating material. When such a configuration is employed, the anode support plate can appropriately electrically block the anode section and the stem from each other.

Preferably, the anode support plate may be provided with a cavity portion for containing the anode section. In this case, the anode section is contained within the cavity portion of the anode support plate, so that the anode section can stably be seated in the anode support plate, and the wall face forming the cavity portion can surround the anode section, whereby the electric shield effect can be improved.

It may further comprise a spacer plate made of ceramics, in contact with an exposed surface of the anode support plate with the anode section interposed therebetween, having an opening for exposing the anode section; and an electrically conductive focusing electrode plate, in contact with a surface of the spacer plate, having a focusing opening disposed coaxial with the opening of the spacer plate, the cathode section being secured within the sealed envelope so as to be spaced from the focusing electrode plate.

When such a configuration is employed, it will be sufficient if the anode support plate, the anode section, the spacer plate, and the focusing electrode plate are successively stacked on the stem within the sealed envelope, whereby each component within the sealed envelope is stabilized, and stable mass production is facilitated in the making of the gas discharge tube.

Preferably, it further comprises a cover plate secured to the focusing electrode plate so as to face a light projection window disposed at an upper part of the side tube and cover the upper side from the cathode section. When such a configuration is employed, the cover plate functions as a shield plate, whereby the sputtering materials or evaporated materials released from the cathode section are blocked by the cover plate and thus become harder to attach to the light projection window.

Preferably, a body of the side tube in the sealed envelope is formed from a metal. When such a configuration is employed, the side tube is easily formed by pressing, which facilitates mass production.

Preferably, the stem is provided with a first flange portion made of a metal, the side tube is provided with a second flange portion made of a metal, and the first and second flange portions are secured to each other by welding. In the case where such a configuration is employed, when the first flange portion provided in the stem and the second flange portion provided in the side tube are aligned face to face, the operation of joining the metals to each other becomes easier, so that the welding operation such as electric welding, laser welding, or the like becomes reliable, which facilitates mass production.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

BRIEF DESCRIPTION OF DRAWINGS

FIG. 9 is a plan view of the anode section in FIG. 1, whereas

FIG. 14 is a plan view of the focusing electrode plate in FIG. 1, whereas

FIG. 16 is a plan view showing the aperture plate in FIG. 1, whereas

DETAILED DESCRIPTION OF PREFERRED EMBODIMENTS

Figure 1:
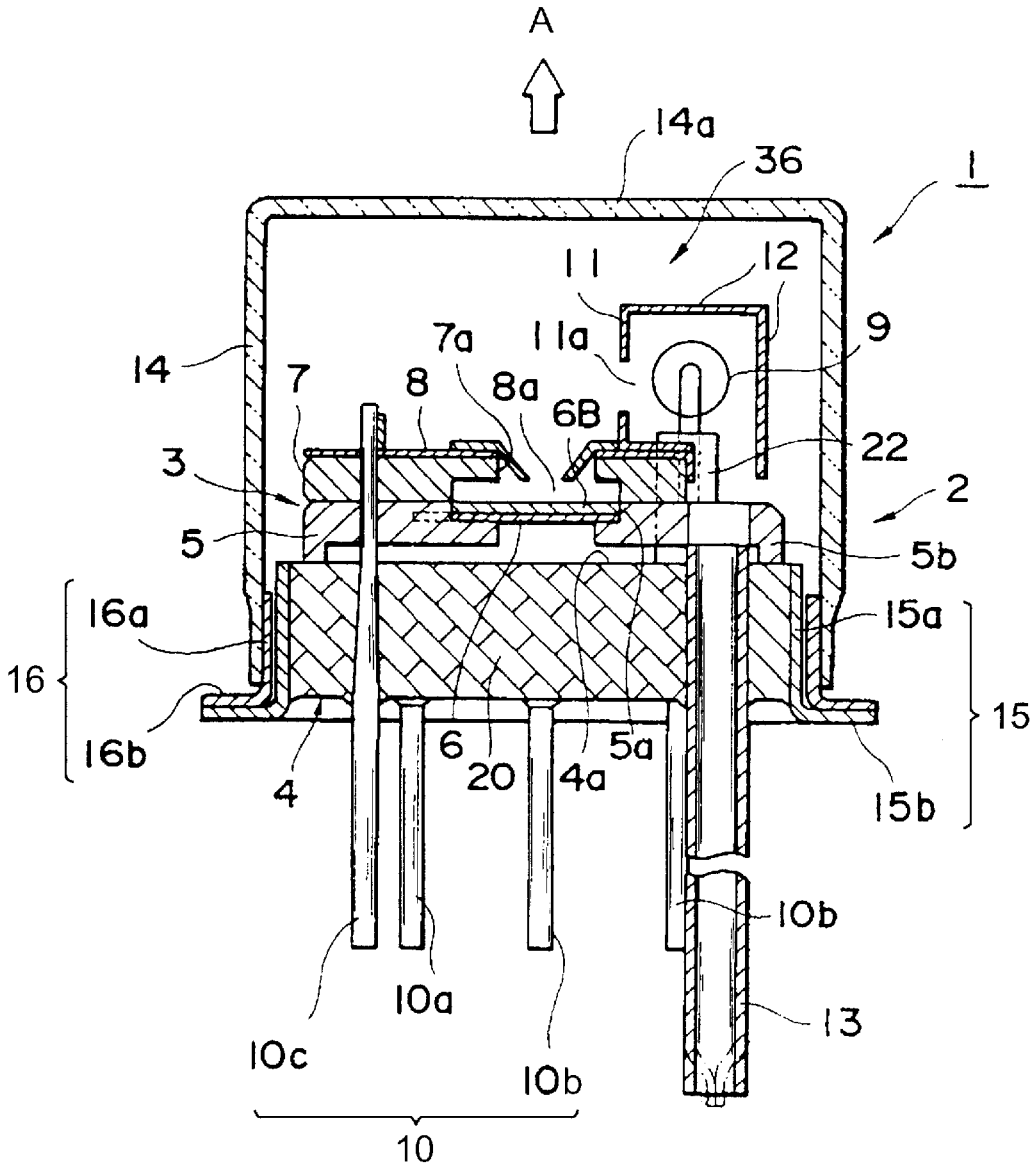
FIG. 1 is a sectional view showing a first embodiment of the gas discharge tube in accordance with the present invention.

In the following, some of preferred embodiments of the gas discharge tube in accordance with the present invention will be explained in detail with reference to the accompanying drawings. To facilitate the comprehension of the explanation, the same reference numerals denote the same parts, where possible, throughout the drawings, and a repeated explanation will be omitted.

FIG. 1 is a sectional view showing the gas discharge tube of a first embodiment in accordance with the present invention. The gas discharge tube 1 shown in this drawing is a head-on type deuterium lamp and has a sealed envelope 2 filled with about several Torr of deuterium gas in order to generate ultraviolet rays, whereas a light-emitting part assembly 3 is contained in the sealed envelope 2. The light-emitting part assembly 3 has an electrically insulating anode support plate 5 which is made of ceramics and disposed on a stem 4 so as to be in contact therewith. A planar anode section 6 is held on the anode support plate 5, so as to be spaced from the stem 4. The upper face of the anode support plate 5 is provided with a cavity portion 5*a* having a shape substantially identical to that of the anode section 6, and the anode section 6 is contained within the cavity portion 5*a*.

Since a configuration in which the anode support plate 5 abuts against the upper face 4*a* of the stem 4 is employed, the high heat generated from the anode section 6 at the time of use of the gas discharge tube 1 is transmitted to the stem 4 by way of the anode support plate 5 and is released outside by way of the stem 4. As a consequence, the cooling efficiency of the anode section 6 can be improved, which contributes to improving the stabilization of operation characteristics. Also, since the anode section 6 employs a configuration in which it is seated on the stem 4 with the anode support plate 5 interposed therebetween, the anode section 6 is stabilized on the stem 4, whereby the resistance to vibration is improved. Further, a simple operation of just mounting the anode support plate 5 onto the stem 4 assembles the anode section 6 into the sealed envelope 2.

A stem pin 10*a* secured so as to penetrate through the stem 4 penetrates through the anode support plate 5, whereas the anode section 6 is secured to the upper end of the stem pin 10*a* by welding. Also, a spacer plate 7 made of ceramics is disposed on the anode support plate 5 so as to be in contact therewith. A focusing electrode 8 secured to the upper end of the stem pin 10*c* is disposed on the spacer plate 7, whereas a focusing opening 8*a* formed in the focusing electrode plate 8 is disposed coaxial with the opening 7*a* of the spacer plate 7 so as to face therein, whereby the focusing electrode plate 8 and the anode section 6 are opposed each other.

For assembling such a light-emitting part assembly 3, it will be sufficient if the anode support plate 5, the anode section 6, the spacer plate 7, and the focusing electrode plate 8 are successively stacked on the stem 4. As a consequence, stable mass production is facilitated when making the gas discharge tube 1. Also, since the light-emitting part assembly 3 does not have a floating structure, it is secured within the sealed envelope 2, whereby a vibration-resistant structure is possible.

Further, in the light-emitting part assembly 3, a cathode section 9 is provided beside the focusing opening 8*a* so as to be spaced from the focusing electrode plate 8. The cathode section 9 is positioned on the upper side from the spacer plate 7, while being welded and secured to the upper end of a stem pin 10*b* secured to the stem 4, and generates thermions as a voltage is applied thereto. Between the cathode section 9 and the focusing opening 8*a*, a discharge rectifying plate 11 is disposed at a position deviated from an optical path (in the direction directly upward from the focusing opening 8*a* in the drawing, i.e., the direction of arrow A). The discharge rectifying plate 11 is provided with an electron releasing window 11*a* formed as a rectangular opening for transmitting therethrough thermions generated in the cathode section 9. Also, the discharge rectifying plate 11 is welded and secured to the upper face of the focusing electrode plate 8, and is provided with a cover plate 12 having an L-shaped cross section so as to surround the upper side of the cathode section 9 and the rear side thereof opposite from the electron releasing window 11*a*. The cover plate 12 keeps the sputtering materials or evaporated materials released from the cathode section 9 from attaching to a light projection window 14*a* disposed at the top part of the sealed envelope 2.

While thus configured light-emitting part assembly 3 is disposed within the sealed envelope 2, an exhaust pipe 13 is secured to the stem 4 since it is necessary for the sealed envelope 2 to be filled with several Torr of deuterium gas. Utilizing this exhaust pipe 13, the sealed envelope 2 can be appropriately filled with a predetermined pressure of deuterium gas after the air is once evacuated therefrom. After the filling, the exhaust pipe 13 is closed, whereby the sealed envelope 2 is sealed off.

Here, the sealed envelope 2 is made hermetic as the junction between a side tube 14 made of silica glass or UV-transmitting glass and the stem 4 is sealed. This side tube 14 is formed like a cylinder whose one side is open, while its top part is utilized as the circular light projection window 14*a*. The stem 4 is formed like a cylindrical column, whose peripheral portion is provided with a first junction member 15 made of a metal (e.g., made of a Kovar metal). The first joint member 15 comprises a cylindrical body portion 15*a*, and a first flange portion 15*b* radially extending like a brim from the lower end of the body portion 15*a*. The body portion 15*a* of the first joint member 15 is secured to the outer wall face of the stem 4 by fusion or bonding.

On the other hand, the open end side of the side tube 14 is provided with a second joint member 16 made of a metal (e.g., made of a Kovar metal), which comprises a cylindrical body portion 16*a* and a second flange portion 16*b* radially extending like a brim from the lower end of the body portion 16*a*. Here, the body portion 16*a* of the second joint member 16 is secured to the inner wall face of the side tube 14 by fusion or bonding, and its positioning is effected by a simple operation of mounting the open end part of the side tube 14 onto the flange portion 16*b*.

Figure 2:
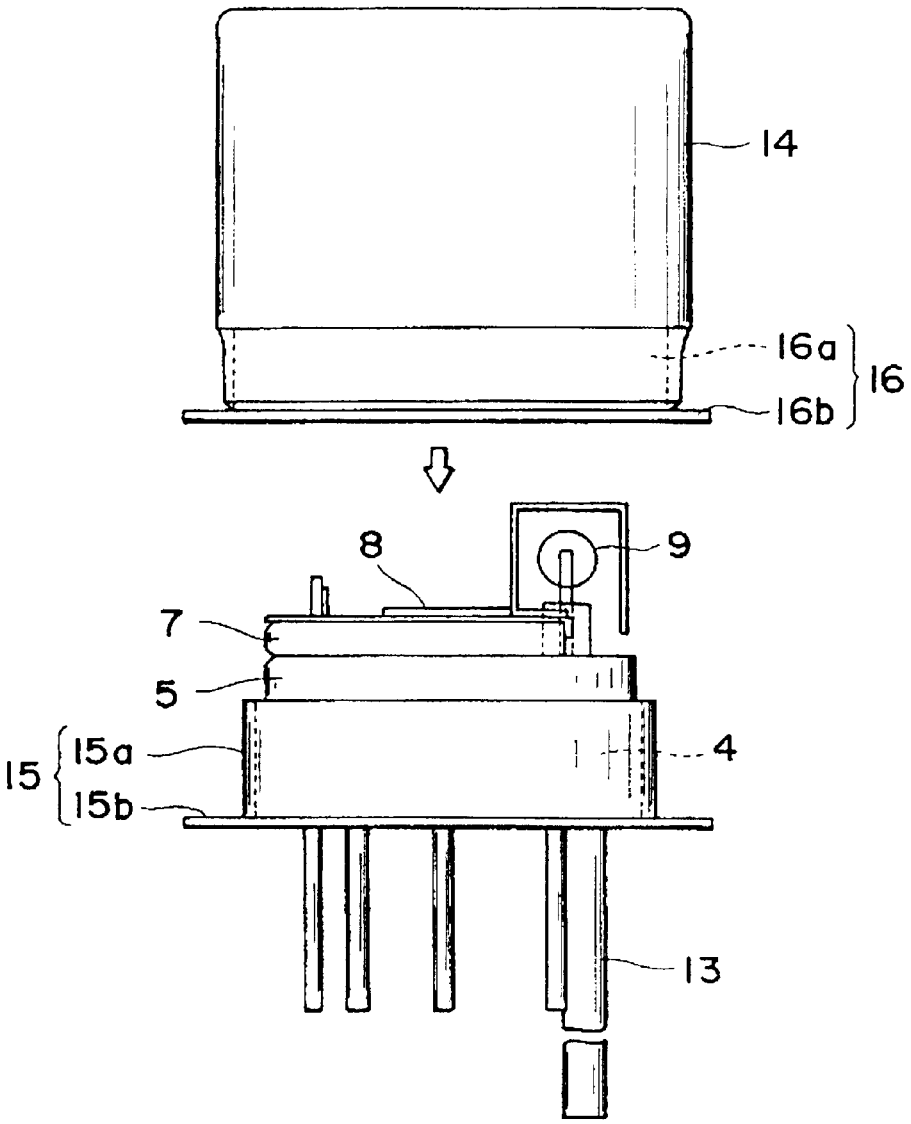
FIG. 2 is a front view of the gas discharge tube shown in FIG. 1 showing a state before its stem and side tube are welded to each other.

Hence, as shown in FIG. 2, while the stem 4 is being inserted into the side tube 14 in a state where the light-emitting part assembly 3 is secured onto the stem 4, the metal flange portion 15*b* of the stem 4 and the metal flange portion 16*b* of the side tube 14 are brought into close contact with each other and, with this state being maintained, thus joined part is subjected to a welding operation such as electric welding, laser welding, or the like, so as to effect hermetic sealing of the sealed envelope 2. After this welding operation, the air in the sealed envelope 2 is evacuated through the exhaust pipe 13, the sealed envelope 2 is subsequently filled with about several Torr of deuterium gas, and the exhaust pipe 13 is hermetically closed thereafter, whereby the assembling operation is completed. Here, the first flange portion 15*b* is utilized as a reference position with respect to the light-emitting part of the gas discharge tube 1 (the part where arc balls are generated in front of the focusing opening 8*a*). Namely, when the positional relationship between the first flange portion 15*b* and the light-emitting part is kept constant upon assembling the discharge tube 1, the positioning of the light-emitting part becomes easier, whereby the assembling workability and positioning accuracy of the gas discharge tube 1 with respect to an apparatus for driving the gas discharge tube 1 (not shown) are expected to improve.

Individual components of the light-emitting part assembly 3 disposed within the sealed envelope 2 and the stem 4 will now be explained in detail.

Figure 3:
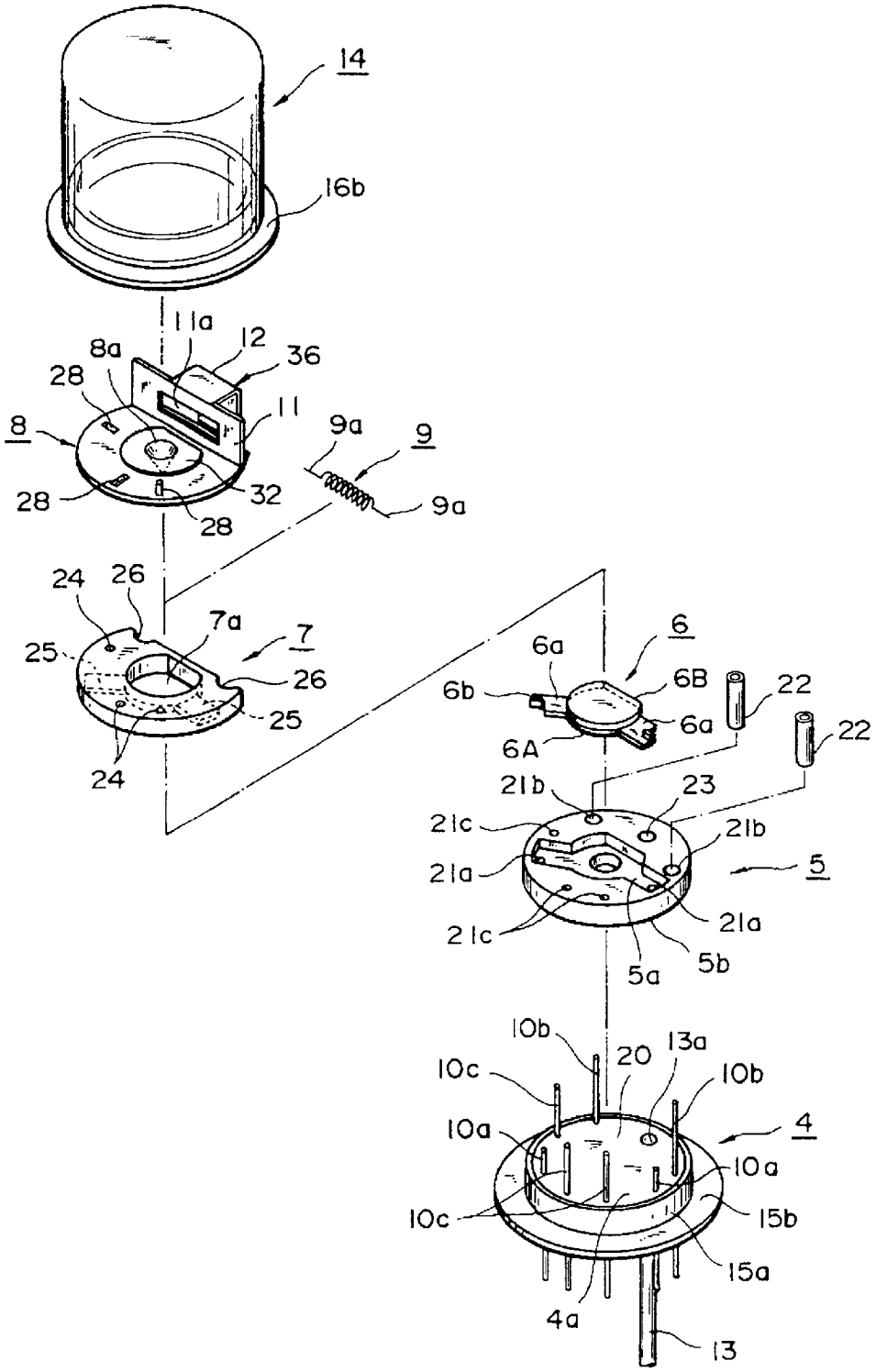
FIG. 3 is an exploded perspective view of the gas discharge tube shown in FIG. 1.
Figure 4:
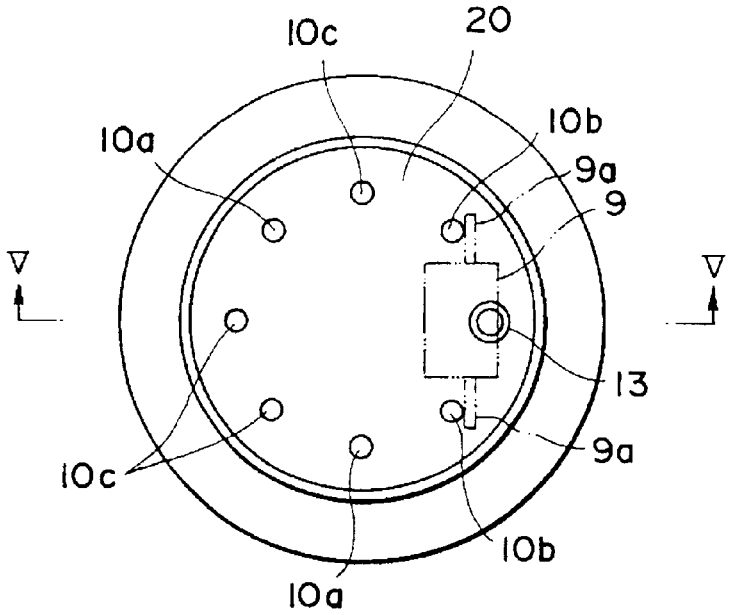
FIG. 4 is a plan view of the stem in FIG. 1.
Figure 5:
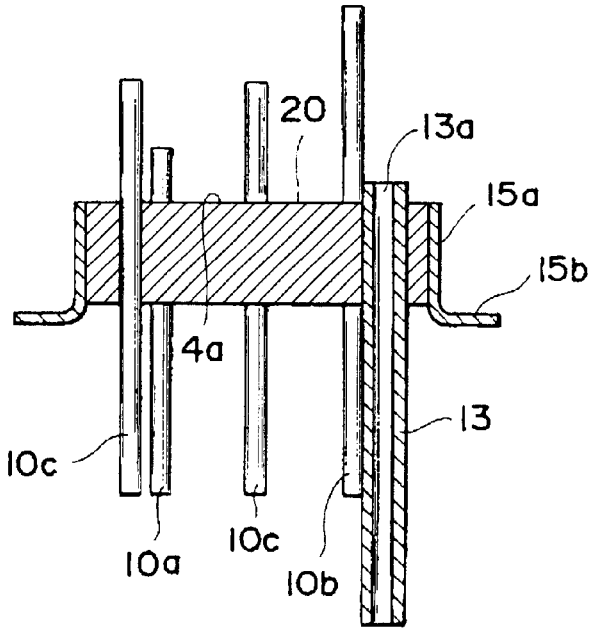
FIG. 5 is a sectional view thereof taken along the line V—V.
Figure 6:
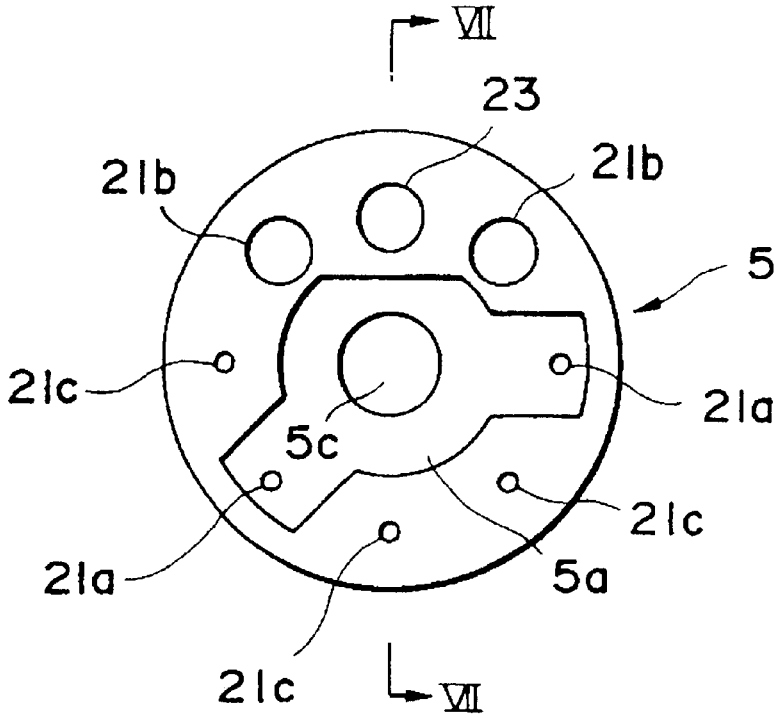
FIG. 6 is a plan view of the anode support plate in FIG. 1.
Figure 7:
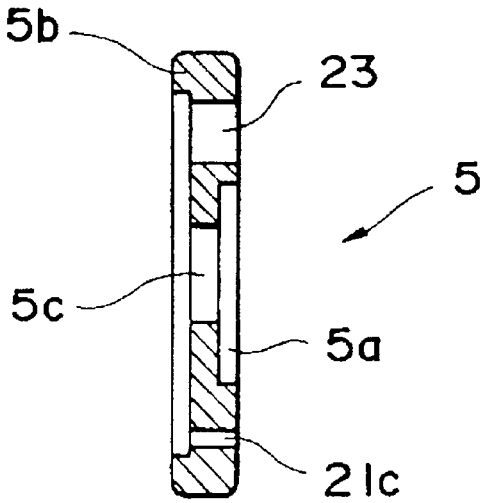
FIG. 7 is a sectional view thereof taken along the line VII—VII.
Figure 8:
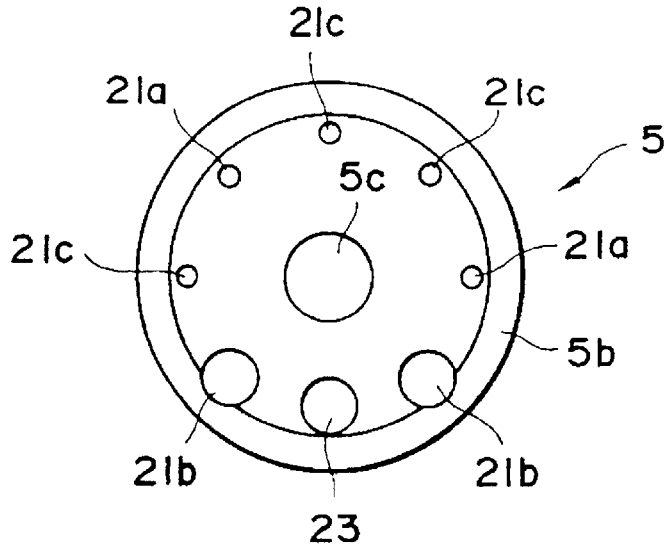
FIG. 8 is a bottom view thereof.

As shown in FIGS. 3 to 5, the stem 4 has a cylindrical base 20 made of Kovar glass at its center, whereas seven stem pins 10 are secured to the base 20 so as to penetrate therethrough and are arranged annularly. The stem pins 10 are constituted by two anode section stem pins 10*a* whose upper ends are secured to the anode section 6 so as to be electrically continuous therewith, two cathode section stem pins 10*b* whose upper ends are secured to the cathode section 9 so as to be electrically continuous therewith, and three focusing electrode plate stem pins 10*c* whose upper ends are secured to the focusing electrode plate 8 so as to be electrically continuous therewith. The individual stem pins 10*a* reset to different lengths such that the surface positions of the anode section 6, focusing electrode plate 8, and cathode section 9 disposed within the sealed envelope 2 successively rise in this order. Namely, among the stem pins 10, their amounts of upward projection from the upper face 4*a* of the base 20 successively increase in the order of the stem pins 10*a*, 10*c*, and 10*b*.

The first joint member 15 made of a metal (e.g., made of a Kovar metal or stainless steel) is secured to a peripheral part of the base 20 of the stem 4, whereas the first joint member 15 is constituted by the cylindrical body portion 15*a* and the first flange portion 15*b* radially extending like a brim from the lower end of the body portion 15*a*. Here, the body portion 15*a* of the first joint member 15 is secured to the outer wall face of the stem 4 by fusion or bonding. The exhaust pipe 13 is secured near the outer periphery of the base 20 such that a ventilation port 13*a* of the exhaust pipe 13 faces between the two cathode section stem pins 10*b*. The ventilation port 13*a* of the exhaust pipe 13 is thus not disposed at the center of the base 20 but shifted to an end thereof and is located substantially directly under the cathode section 9 so as to correspond thereto, in order to rapidly aspirate the gases liberated upon activating the cathode section 9 by energization during the assembling step of the gas discharge tube 1.

As shown in FIGS. 3 and 6 to 8, the ceramics-made anode support plate 5 made of an electrically insulating material is formed like a disk whose upper face is provided with the cavity portion 5*a* having a form matching the anode section 6, whereas the peripheral portion of the lower face of the anode support plate 5 is provided with a ring-shaped pedestal 5*b* for abutting against the upper face of the base 20. The center of the anode support plate 5 is provided with a circular through hole 5*c*. Also, the anode support plate 5 is provided with seven pin holes 21 through which the stem pins 10 penetrate, whereas the pin holes 21 are arranged annularly. The pin holes 21 are constituted by two pin holes 21*a* through which the anode section stem pins 10*a* penetrate, two pin holes 21*b* through which the cathode section stem pins 10*b* penetrate, and three pin holes 21*c* through which the focusing electrode plate stem pins 10*c* penetrate, whereas the individual pin holes 21*a* to 21*c* are disposed so as to correspond to the respective positions of the stem pins 10*a* to 10*c*.

Each of the pin holes 21*b* has a diameter greater than that of the other pin holes 21*a*, 21*c*, in order for a ceramics-made electrically insulating pipe 22 (see FIG. 3) to be inserted therein. As the stem pin 10*b* is inserted into the pipe 22, the exposed part of the stem pin 10*b* in the sealed envelope 2 becomes smaller, thereby reliably preventing abnormal electric discharge from occurring in the stem pin 10*b* (see FIG. 1). Here, a ventilation hole 23 into which the ventilation port 13*a* of the exhaust pipe 13 faces is disposed between the two pin holes 21*b*.

Figure 9:
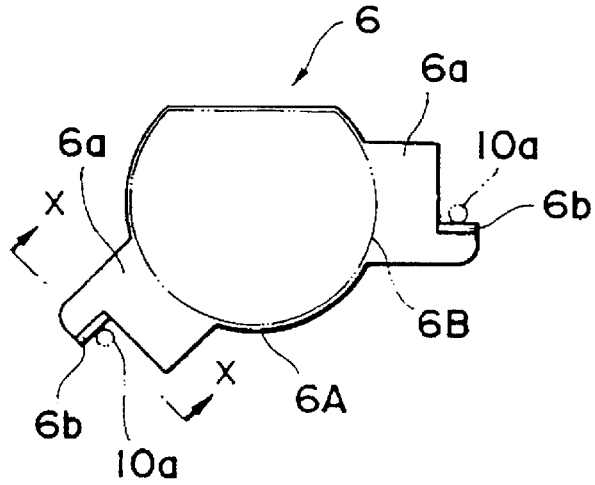
Figure 10:
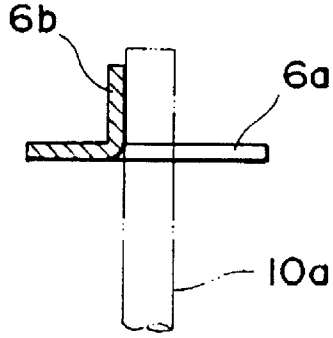
FIG. 10 is an enlarged sectional view thereof taken along the line X—X.
Figure 11:
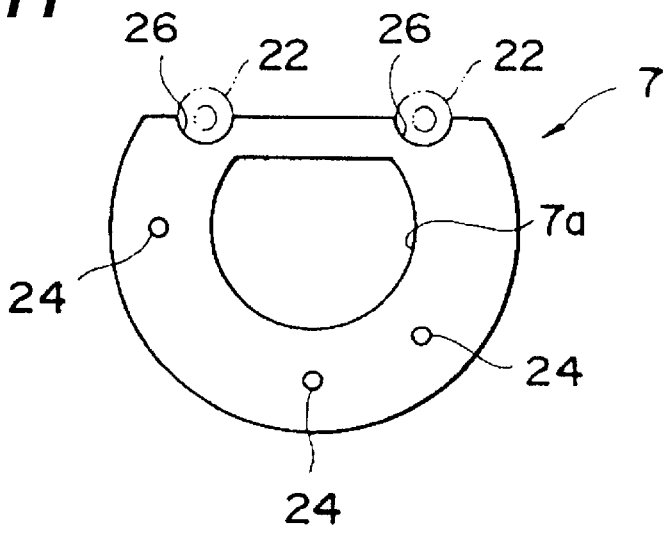
FIG. 11 is a plan view of the spacer plate in FIG. 1.

As shown in FIGS. 3, 9, and 10, the metal-made anode section 6 comprises a base plate 6A having lead portions 6*a* extending on both sides, and an anode plate 6B which is substantially shaped like a half moon and secured onto the base plate 6A by welding. The free end of each lead portion 6*a* is provided with a riser 6*b* formed by bending. Since the lead portions 6*a* are provided with the respective risers 6*b*, it becomes easier for the upper ends of the stem pins 10*a* to be secured to the anode section 6 by welding. Since the planar anode section 6 composed of the base plate 6A and anode plate 6B is contained in the cavity portion 5*a* of anode support plate 5 having an outer form substantially identical thereto, the anode section 6 can stably be seated in the anode support plate 5, and a wall face forming the cavity portion 5*a* can surround the anode section 6, whereby an electric shield effect can be expected.

Figure 12:
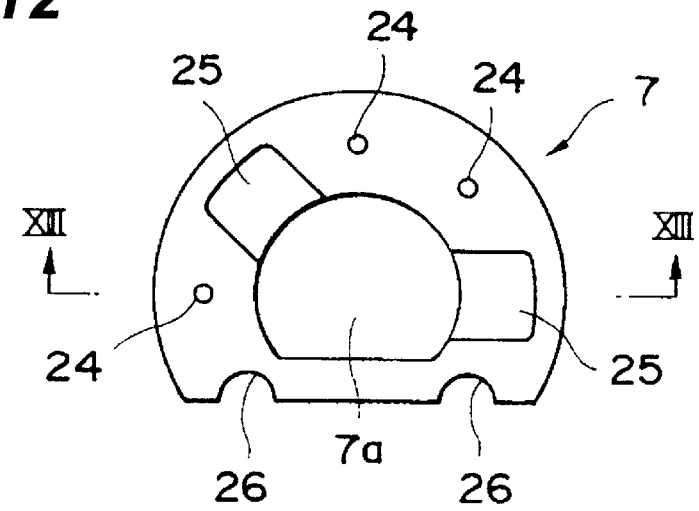
FIG. 12 is a bottom view thereof.
Figure 13:
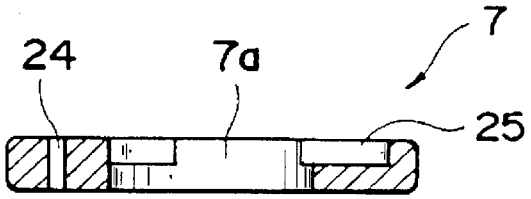
FIG. 13 is a sectional view thereof taken along the line XIII—XIII.

As shown in FIGS. 3 and 11 to 13, the ceramics-made spacer plate 7 substantially shaped like a half moon has the opening 7*a* substantially matching the form of the anode plate 6B, the surroundings of the opening 7*a* are provided with three pin holes 24 through which the respective upper ends of the stem pins 10*c* penetrate, and a depressed release portion 25 is disposed on the rear face of the spacer plate 7 at a position corresponding to each lead portion 6*a* of the anode section 6 (see FIG. 12). When such release portions 25 are provided, then the risers 6*b* of the anode section 6 are securely kept from abutting against the spacer plate 7. Further, the periphery of the spacer plate 7 is provided with half-moon-shaped cutouts 26 for receiving the respective ceramics-made pipes 22.

Figure 14:
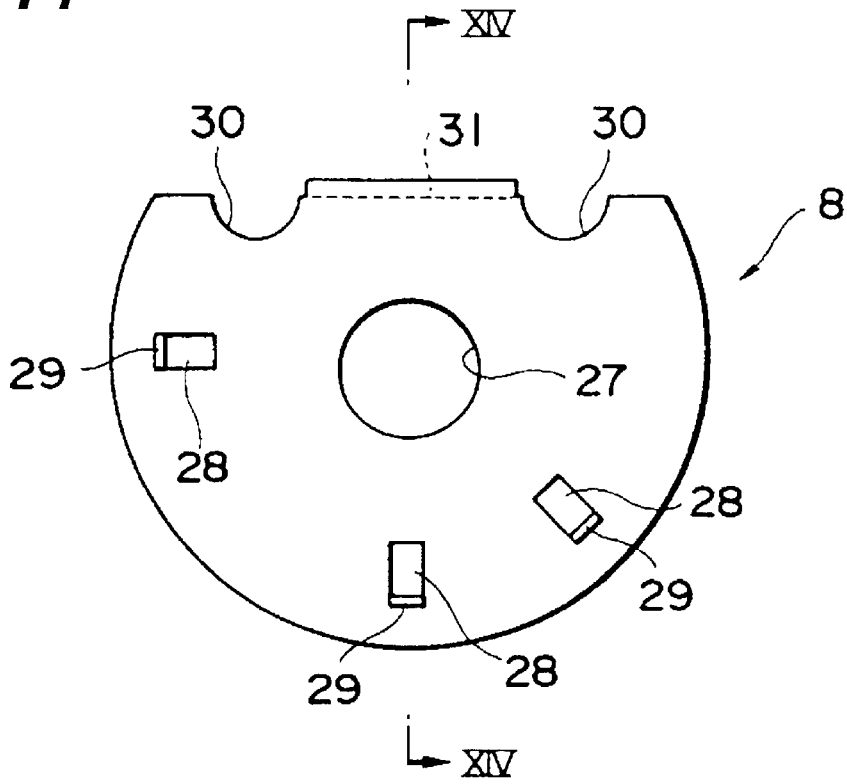
Figure 15:
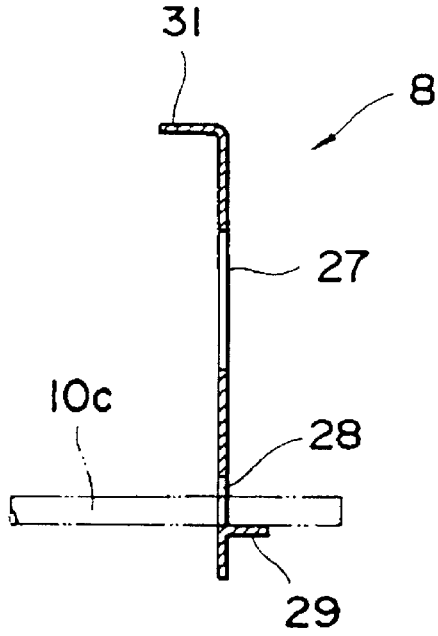
FIG. 15 is a sectional view thereof taken along the line XIV—XIV.

As shown in FIGS. 3, 14, and 15, the metal-made focusing electrode plate 8 is formed substantially like a half moon so as to be substantially identical to the spacer plate 7 and is provided with a circular opening 27 at a position opposed to the anode section 6, and the surroundings of the opening 27 are provided with three pin holes 28 into which the respective upper ends of the stem pins 10*c* are inserted. A riser 29 is disposed near each pin hole 28. Each riser 29 is made by lug-raising molding upon pressing carried out at the time of forming its corresponding pin hole 28. Since each riser 29 is employed, it is made easier for the upper end of each stem pin 10*c* to be secured to the focusing electrode plate 8 by welding. Further, the periphery of the focusing electrode plate 8 is provided with half-moon-shaped cutouts 30 for receiving the respective pipes 22, whereas the individual cutouts 30 correspond to the respective cutouts 26 of the spacer plate 7. In the focusing electrode plate 8, a tongue 31 is formed by bending between the cutouts 30, whereas the tongue 31 is caused to abut against the end portion of the spacer plate 7, thereby acting to position and hold the focusing electrode plate 8.

Figure 16:
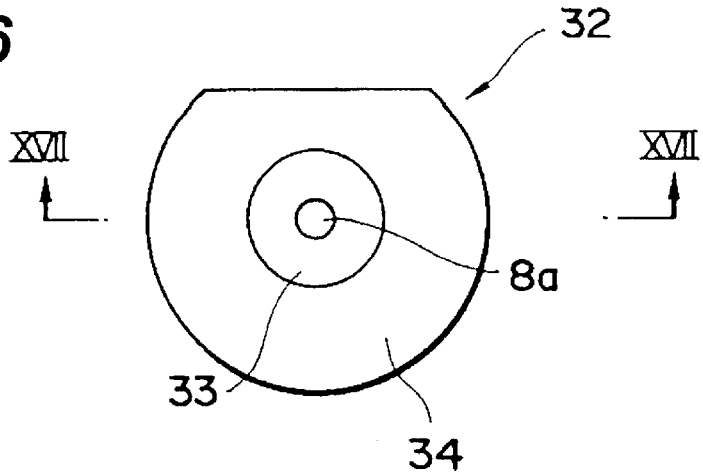
Figure 17:
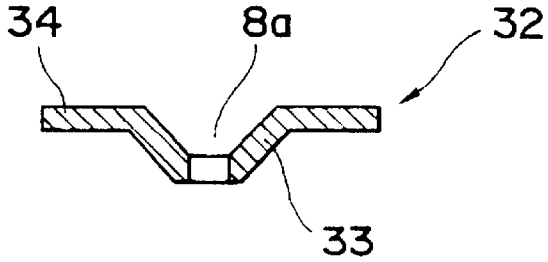
FIG. 17 is a sectional view thereof taken along the line XVII—XVII.
Figure 18:
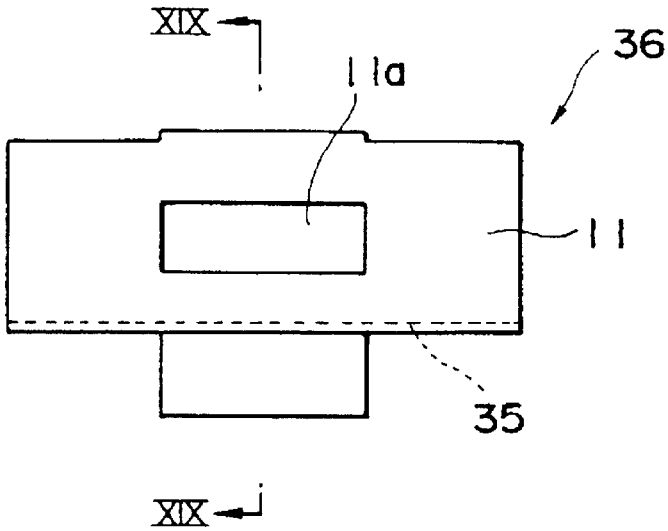
FIG. 18 is a front view showing the cathode surrounding portion in FIG. 1.
Figure 19:
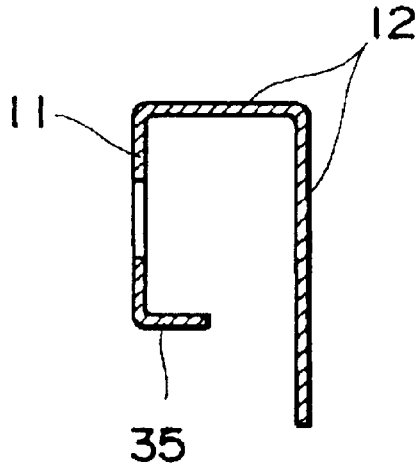
FIG. 19 is a sectional view thereof taken along the line XIX—XIX.
Figure 20:
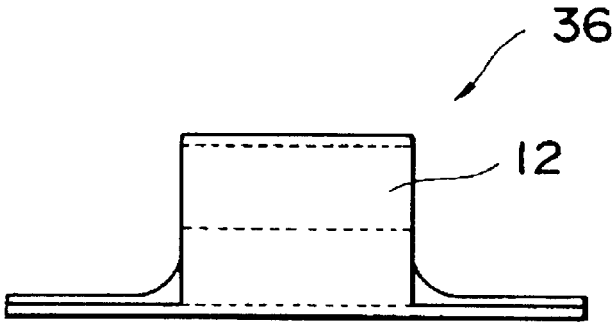
FIG. 20 is a plan view thereof.

As shown in FIGS. 3, 16, and 17, a metal-made aperture plate 32 having a funnel-shaped focusing aperture 8*a* is welded and secured to the upper face of the focusing electrode plate 8, the aperture plate 32 has a funnel-shaped focusing portion 33 for securing the focusing aperture 8*a*, and the focusing portion 33 is opposed to the anode section 6 as being inserted into the opening 27 of the focusing electrode plate 8. Further, the aperture plate 32 has a substantially half-moon-shaped flange portion 34 about the focusing portion 33, and the focusing electrode plate 8 and the aperture plate 32 are integrated with each other as the flange portion 34 is welded to the focusing electrode plate 8.

As shown in FIGS. 3 and 18 to 20, a metal-made cathode surrounding portion 36 formed by bending is secured to the upper face of the focusing electrode plate 8, whereas the discharge rectifying plate 11 disposed at the cathode surrounding portion 36 is integrated with the focusing electrode plate 8 by way of a welding piece 35. The discharge rectifying plate 11 perpendicularly rises from the upper face of the focusing electrode plate 8 and has the electron releasing window 11*a* as a rectangular opening for passing therethrough the thermions emitted from the cathode section 9. Also, the discharge rectifying plate 11 is provided with the cover plate 12 bent so as to yield an L-shaped cross section surrounding the upper side of the cathode section 9 and the rear side thereof opposite from the electron releasing window 11*a*. The cover plate 12 keeps the sputtering materials or evaporated materials released from the cathode section 9 from attaching to the light projection window 14*a* disposed at the top part of the sealed envelope 2. The discharge rectifying plate 11 and the cover plate 12 are integrally made as the cathode surrounding portion 36, which is secured to the upper face of the focusing electrode plate 8 by welding.

Here, a method of assembling the deuterium lamp 1 will be explained in brief with reference to FIGS. 1 and 3.

First, the stem 4 in which seven stem pins 10 and the exhaust pipe 13 are secured to the base 20 is prepared. Then, the pedestal 5*b* of the anode support plate 5 is caused to abut against the upper face 4*a* of the stem 4 such that the individual stem pins 10 penetrate through their corresponding pin holes 21. As a result, the stem pins 10 and pin holes 21 achieve secure positioning of the anode support plate 5 on the stem 4. Thereafter, the anode section 6 is contained in the cavity portion 5*a* of the anode support plate 5, and the risers 6*b* of the anode section 6 and the respective tips of the stem pins 10*a* are welded to each other (see FIG. 10). Subsequently, the pipes 22 made of ceramics are inserted into their corresponding pin holes 21*b* in the anode support plate 5 such that the individual stem pins 10*b* are plugged into the respective pipes 22. Thereafter, the spacer plate 7 is caused to abut onto the anode support plate 5 such that the individual stem pins 10*c* are inserted into their corresponding pin holes 24 of the spacer plate 7, and the anode section 6 is disposed between the anode support plate 5 and the spacer plate 7. Here, the half-moon-shaped anode plate 6B of the anode section 6 is disposed so as to be seen from the opening 7*a* of the spacer plate 7.

Thereafter, the respective tips of the stem pins 10*b* are welded and secured to the individual leads 9*a* provided on both sides of the cathode section 9. Then, the stem pins 10*c* are inserted into their corresponding pin holes 28 of the focusing electrode plate 8 such that the cover plate 12 of the focusing electrode plate 8 covers the cathode section 9, and the stem pins 10*c* are welded to their corresponding risers 29 of the focusing electrode plate 8 in a state where the focusing electrode plate 8 abuts against the spacer plate 7. Here, the cathode section 9 faces into the electron releasing window 11*a* of the discharge rectifying plate 11, whereas the anode plate 6B faces into the focusing opening 8*a* of the focusing electrode plate 8.

After thus being assembled onto the stem 4, the light-emitting part assembly 3 is covered with the side tube 14 from thereabove, and the metal-made flange portion 15*b* of the stem 4 and the metal-made flange portion 16*b* of the side tube 14 are brought into close contact with each other. While this state is being maintained, their joint part is subjected to a welding operation such as electric welding, laser welding, or the like, whereby the sealed envelope 2 is hermetically sealed. After the welding operation, energization is carried out for activating the cathode section 9. After the gases within the sealed envelope 2 are evacuated through the exhaust pipe 13, the sealed envelope 2 is filled with about several Torr of deuterium gas, and then the exhaust pipe 13 is closed, so that the sealed envelope 2 is hermetically sealed, whereby the operation of assembling the deuterium lamp 1 is completed.

Operations of thus configured gas discharge tube 1 will now be explained in brief. First, an electric power of about 10 W is supplied from an external power source to the cathode section 9 for about 20 seconds, so as to preheat the cathode section 9. Thereafter, a DC release voltage of about 150 V is applied across the cathode section 9 and the anode section 6, so as to prepare for arc discharge.

In the state where the preparation is in order, a trigger voltage of about 350 V to 500 V is applied across the cathode section 9 and the anode section 6. Here, while being rectified by the discharge rectifying plate 11, the thermions released from the cathode section 9 converge at the focusing opening 8*a* of the focusing electrode plate 8 and reach the anode plate 6B of the anode section 6. Then, arc discharge occurs in front of the focusing opening 8*a,* and ultraviolet rays taken out from the arc balls generated upon this arc discharge are transmitted through the light projection window 14*a* of the side tube 14 and released outside.

Figure 21:
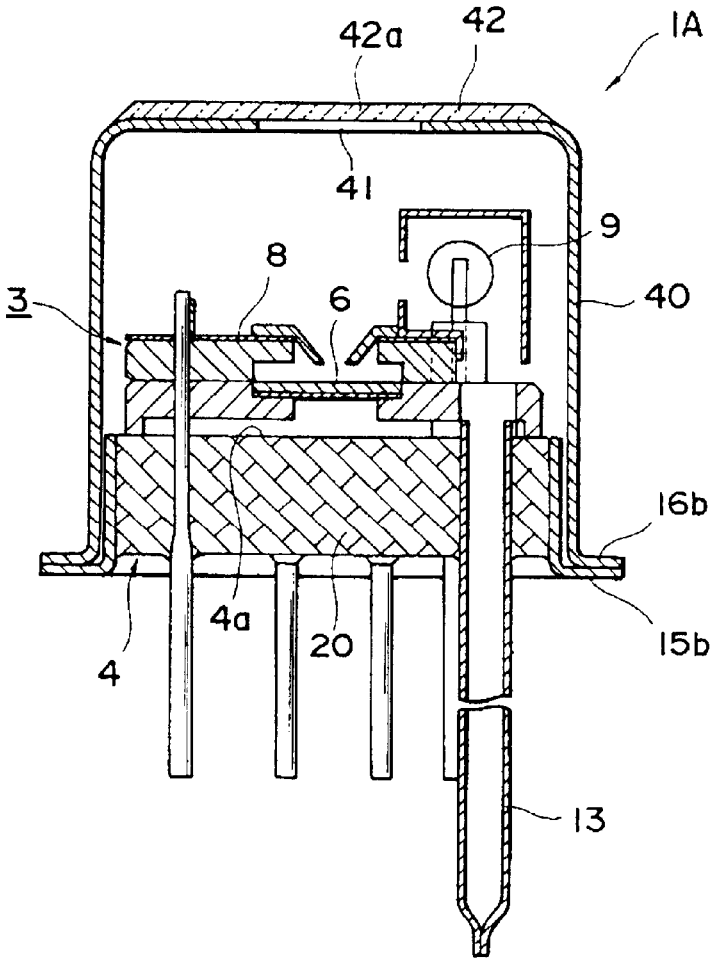
FIGS. 21 to 23 are sectional views showing second to fourth embodiments of the gas discharge tube in accordance with the present invention, respectively.

Without being restricted to the above-mentioned embodiment, the present invention may be formed as a gas discharge tube 1A using a side tube 40 made of a metal (e.g., Kovar metal or stainless steel), for example, as shown in FIG. 21. For forming a light projection window 42*a,* the side tube 40 has an opening portion 41 at the center of its top part, and a window member 41 made of glass is fused to the upper face of the side tube 40. Thus, since the side tube 40 is made of a metal, its formation is easily done by pressing, which facilitates mass production. Also, the side tube 40 can easily be produced with various forms. Here, Kovar glass may be fused to the inner wall face or outer wall face of the side tube 40.

Figure 22:
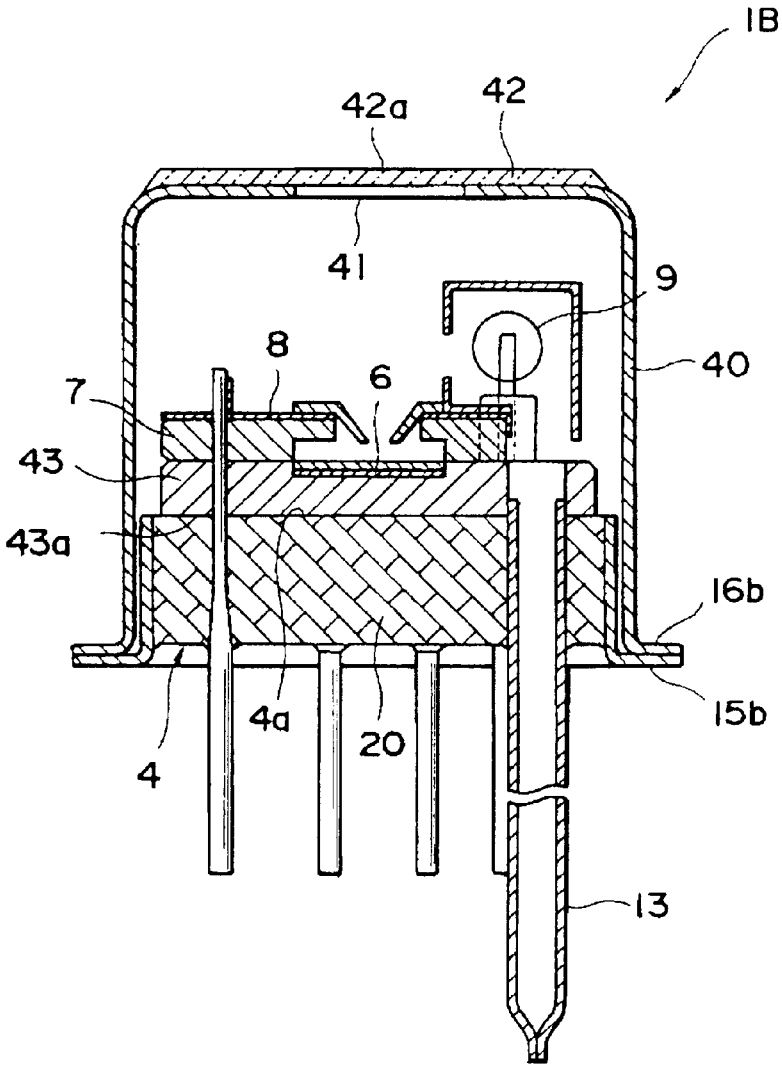

In another embodiment, as shown in FIG. 22, a gas discharge tube 1B may have an anode support plate 43 without the pedestal 5*b.* In this case, the whole bottom face 43*a* of the anode support plate 43 abuts against the upper face 4*a* of the base 20 of the stem 4. As a result of such a configuration, heat radiation can be effected by the whole contact surface.

Figure 23:
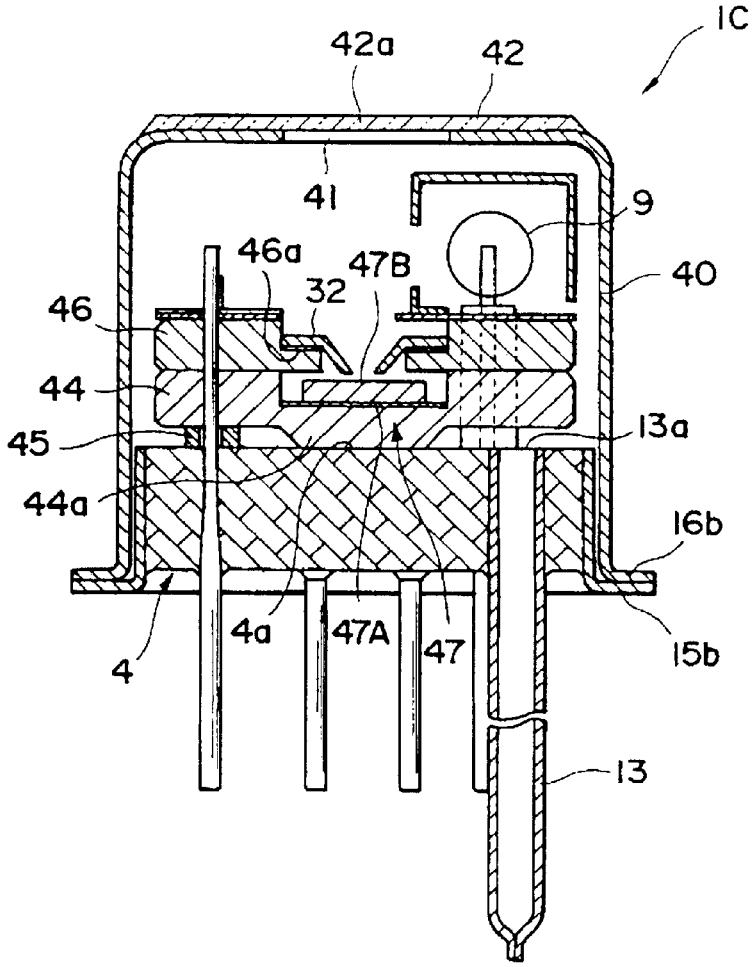

In still another embodiment, as shown in FIG. 23, a gas discharge tube 1C has a pedestal 44*a* disposed at the center of the bottom face of the anode support plate 44, whereas the peripheral portion of the anode support plate 44 is disposed above the stem 4 with a gap therebetween so as not to block the ventilation port 13*a* of the exhaust pipe 13. Also, electrically insulating pipes 45 made of ceramics are disposed so as to fill the gap, and stem pins are inserted through the pipes 45. As a result, though there is a gap between the anode support plate 44 and the stem 4, the pipes 45 can appropriately prevent the abnormal electric discharge of the stem pins 10 from occurring in this portion. Also, an aperture plate 32 is contained in a depression 46*a* formed at the center of a spacer plate 46, whereby the positioning of the aperture plate 32 is facilitated. Further, the anode plate 47B disposed on the base plate 47A of the anode section 47 is formed thicker, so as to keep the anode section 47 from raising its temperature more than necessary.

Examples of the gas filling the sealed envelope 2 include not only deuterium gas but also hydrogen, mercury vapor, helium gas, neon gas, argon gas, or the like, and these gases should be chosen according to the use. The present invention is also applicable to side-on type discharge tubes as a matter of course.

While Kovar glass is used for the base 20 of the stem 4 in the foregoing explanations, ceramics may be used as well. Also, while the stem 4 is constituted by the base 20 through which the individual stem pins penetrate and the metal-made flange portion 15*b,* it may be a metal-made stem 4 integrally molded with the flange portion 15*b.* In this case, each stem pin 10 may be secured to the metal-made stem 4 by use of hermetic sealing of glass.

Since the gas discharge tube in accordance with the present invention is configured as in the foregoing, it can improve the resistance to vibration, enhance the heat-radiating characteristic of the anode section, and facilitate the easiness in assembling.

The present invention is suitably applicable to a gas discharge tube, such as a gas discharge tube for use as a light source for a spectroscope, chromatography, or the like in particular; and is employable as a deuterium lamp, mercury lamp, helium gas lamp, neon gas lamp, argon gas lamp, or the like, for example.

From the foregoing explanations of the invention, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A gas discharge tube having a sealed envelope at least a part of which transmits light, said sealed envelope being filled with a gas and being provided with anode and cathode sections disposed therein, electric discharge being generated between said anode and cathode sections, so that the light-transmitting part of said sealed envelope emits predetermined light outside;

said sealed envelope comprising:

a stem for securing said anode and cathode sections by way of respective stem pins independent from each other; and an anode support plate mounted directly on an inner surface of said stem for mounting said anode section on a surface thereof.

2. A gas discharge tube according to claim 1, wherein said anode support plate is made of an electrically insulating material.

3. A gas discharge tube according to claim 1, wherein said anode support plate is provided with a cavity portion for containing said anode section.

4. A gas discharge tube according to claim 1, further comprising:

a spacer plate made of ceramics, in contact with an exposed surface of said anode support plate with said anode section interposed therebetween, having an opening for exposing said anode section; and an electrically conductive focusing electrode plate, in contact with a surface of said spacer plate, having a focusing opening disposed coaxial with the opening of said spacer plate;

wherein said cathode section being secured within said sealed envelope so as to be spaced from said focusing electrode plate.

5. A gas discharge tube according to claim 4, wherein said sealed envelope has a light projection window opposite to said stem, and a cover plate disposed between said light projection window and said cathode section.

6. A gas discharge tube according to claim 4, wherein a body of said sealed envelope is formed from a metal.

7. A gas discharge tube according to claim 1, wherein said stem is provided with a first flange portion made of a metal, said sealed envelope is provided with a second flange portion made of a metal, and said first and second flange portions are secured to each other by welding.

8. A gas discharge tube having a sealed envelope at least a part of which transmits light, said sealed envelope being filled with a gas and being provided with anode and cathode sections disposed therein, electric discharge being generated between said anode and cathode sections, so that the light-transmitting part of said sealed envelope emits predetermined light outside;

said sealed envelope comprising:

a stem for securing said anode and cathode sections by way of respective stem pins independent from each other, said stem being provided with a first flange portion made of metal;

a side tube, made of a material at least a part of which transmits light and secured to said stem, surrounding said anode and cathode sections, said side tube being provided with a second flange portion made of metal, said first and second flange portions being secured to each other by welding; and an anode support plate abutting against said stem so as to support said anode section on a surface thereof.

* * * * *